United States Patent [19]

Clark

[11] 3,961,725

[45] June 8, 1976

[54] METHOD AND APPARATUS FOR DISPENSING FLUIDS UNDER PRESSURE

[76] Inventor: Richard A. Clark, 12 Kirkwood Drive, Glen Cove, N.Y. 11542

[22] Filed: Apr. 9, 1974

[21] Appl. No.: 459,440

[52] U.S. Cl. ..... 222/1; 222/211; 222/212; 222/215; 222/386.5

[51] Int. Cl.[2] ..... B65D 37/00

[58] Field of Search ..... 222/386.5, 387, 105, 222/107, 211, 215, 406, 407, 212, 183, 95, 96, 1

[56] References Cited

UNITED STATES PATENTS

| | | | |
|---|---|---|---|
| 176,279 | 4/1976 | Chinnock | 222/211 |
| 3,361,303 | 1/1968 | Jacuzzi | 222/183 |
| 3,468,308 | 9/1969 | Bierman | 128/214 |
| 3,469,578 | 9/1969 | Bierman | 222/215 |
| 3,486,539 | 12/1969 | Jacuzzi | 222/189 |
| 3,506,005 | 4/1970 | Gilio et al. | 128/214 |
| 3,672,543 | 6/1972 | Roper et al. | 222/183 |
| 3,698,595 | 10/1972 | Gortz | 222/105 |
| 3,738,538 | 6/1973 | Roper et al. | 222/183 |
| 3,767,078 | 10/1973 | Gortz | 220/63 R |
| 3,791,557 | 2/1974 | Venus | 222/105 |
| 3,796,356 | 3/1974 | Venus, Jr. | 222/212 |

*Primary Examiner*—Allen N. Knowles
*Attorney, Agent, or Firm*—Seidel, Gonda & Goldhammer

[57] ABSTRACT

An improved method and apparatus are provided for dispensing fluids under pressure by means of an expandable resilient bladder, wherein the bladder expands upon filling with a fluid, and the resilient character of the expanded bladder provides the pressure for expelling the fluid. The improved method comprises mechanically tensioning the bladder as the bladder is being filled with fluid, and maintaining the mechanical tensioning of the bladder at least until substantially all of the fluid is expelled therefrom. This mechanical tensioning provides a substantially uniform high pressure on the fluid throughout the dispensing of the fluid, and substantially all of the fluid may be dispensed from the apparatus. The improved apparatus for carrying out this mechanical tensioning may advantageously comprise relatively rigid telescoping members located interior of the bladder. The telescoping members are actuated by the fluid as it is being introduced into the apparatus such that the telescoping members are moved to an extended position which longitudinally tensions the bladder. Suitable means are provided for detaining the telescoping members in the extended position at least until substantially all of the fluid is dispensed from the apparatus.

15 Claims, 5 Drawing Figures

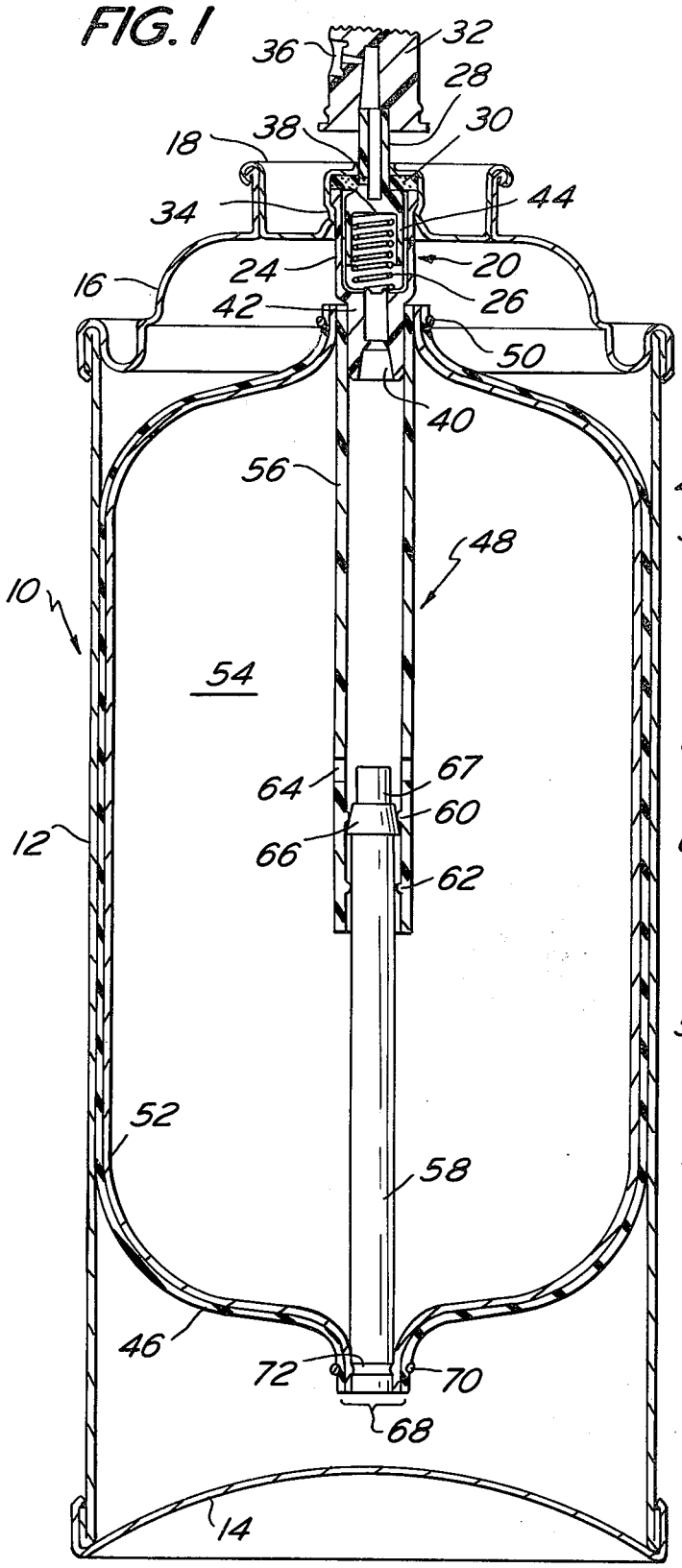
FIG. 1
36
32
28
30
38
18
34
44
24
20
16
26
42
50
40
56
48
10
54
64
67
60
66
12
62
52
58
46
72
70
68
14
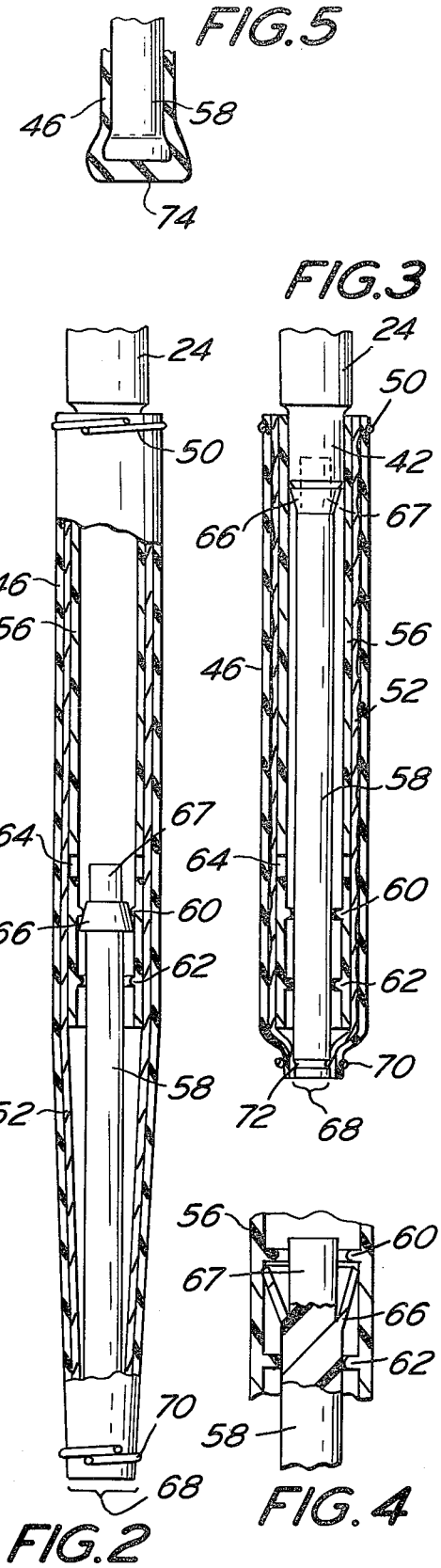
FIG. 5
46
58
74
FIG. 3
24
50
42
66
67
56
46
52
58
64
60
62
70
72
68
FIG. 2
24
50
46
56
67
64
60
66
62
58
52
70
68
FIG. 4
56
60
67
66
62
58

METHOD AND APPARATUS FOR DISPENSING FLUIDS UNDER PRESSURE

BACKGROUND OF THE INVENTION

The present invention relates to an improved method and apparatus for dispensing fluids under pressure. More particularly the present invention is directed to the dispensing of liquids under pressure by means of an expandable resilient bladder.

A large variety of different types of apparatus is available for dispensing fluids, particularly liquids, from handheld bottles, cans and other containers. Such apparatus includes squeeze bottles, pressure packs, aspirators, and various sorts of mechanical pumps, ranging from the very simple to the very sophisticated.

For a number of years now one of the most popular and widely used forms of dispensers has been the pressure pack, particularly the so-called aerosol dispenser. The aerosol dispensers have been particularly popular for dispensing hair care products and personal hygiene products. The major advantage of the aerosol type dispenser is that it develops sufficient pressure on the fluid to be dispensed to provide the quantity of energy needed for atomization of the liquid. Thus, it is well known that the finer the droplet size required in a spray, the greater is the quantity of energy which must be supplied.

However, aerosol products presently known have come under scrutiny as possible health hazards when used for certain products. Thus, the propellants generally used may be hazardous when inhaled. Moreover, the potential pressures developed in some aerosol containers and products may also create safety hazards because of the possibility of explosions.

A recently developing alternative to the use of aerosol propellants for providing the motive force in pressure pack dispensers has been the development of resilient elastomeric bladders or sacks within the container or dispenser for the fluid. The resilient or elastic properties of the bladder provide the physical pressure on the fluid for dispensing as a pressurized product.

Although such elastomeric bladders have been around for many years in various crude and simple forms, two major problems have attended the use of such apparatus. First of all, it has been extremely difficult or impossible to obtain the relatively high pressures which may be obtained with the use of aerosol propellants. Secondly, a significant portion of the fluid product is usually wasted due to the fact that the pressure exerted by the bladder expires well before the bladder is completely empty, and there is no way of utilizing the remaining product in the bladder.

In recent years, the latter disadvantage has been greatly reduced by resorting to various means of prestressing or pre-tensioning of the bladder. That is, during the manufacture of the dispenser, some means is provided for stretching or tensioning the bladder prior to the filling of the dispenser with the fluid. Examples of such pre-tensioning devices are disclosed in U.S. Pat. Nos. 3,738,538; 3,506,005; 3,698,595; 3,361,303; 3,672,543; 3,767,078; 3,468,308 and 3,469,578.

Unfortunately, the above pre-tensioning device have not completely solved the problem of expelling substantially all of the fluid from the bladder. Moreover, even with the use of pre-tensioning, the pressure on the fluid has been found to decrease rather steadily as the bladder is emptied, so that uniform pressure is not provided for dispensing the product. Since proper atomization requires pressure and energy, the reduction in pressure may result in a good, fine spray when the dispenser is full, but a poor, drippy spray when the dispenser is almost empty.

Accordingly, it is desirable to have a non-aerosol type pressure pack dispenser which will not only be capable of dispensing substantially all of the fluid product contained therein, but will also provide a substantially uniform pressure throughout the dispensing of the fluid.

BRIEF SUMMARY OF THE INVENTION

The above and other disadvantages of the prior art may be alleviated by the method and apparatus of the present invention. According to the improved method of the invention, the expandable resilient bladder, which contains a fluid to be dispensed and provides the pressure for expelling the fluid, is mechanically tensioned during the filling of the bladder with fluid, as well as being tensioned by expansion as it is filled with fluid. During dispensing of the fluid, the fluid tensioning of the bladder is gradually released, while the mechanical tensioning of the bladder is maintained at least until substantially all of the fluid is expelled therefrom. Preferably, the bladder is in a substantially untensioned state prior to commencement of the filling of the container with fluid, and the mechanical tensioning is applied internally of the bladder by stretching the bladder along its longitudinal axis. The mechanical tensioning is advantageously actuated by the commencement of the filling of the container with fluid.

The apparatus of the present invention comprises extensible means located interior of the bladder, which extensible means are operable from a first non-extended position wherein the bladder is substantially untensioned to a second extended position wherein the bladder is tensioned. The extensible means are actuated to the extended position by fluid being introduced into the apparatus, and means are provided for detaining the extensible means in the extended position at least until substantially all of the fluid is dispensed from the apparatus. Advantageously, the extensible means may comprise at least two relatively rigid telescoping members, which slide with respect to each other, with one of the members being a tubular member through which fluid may be conveyed into and out of the bladder. A second telescoping member may comprise a piston-like member which slides on the tubular member and may or may not have its free end attached to the bladder.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a sectional side elevation view of one form of an apparatus according to the present invention, wherein the dispenser is in its filled or substantially filled position.

FIG. 2 is a fragmented view, partially in cross section, illustrating the improved features of the apparatus when the bladder is substantially empty.

FIG. 3 is a fragmented sectional view illustrating the improved features of the apparatus prior to commencement of the filling of the apparatus with fluid.

FIG. 4 is a further fragmented sectional view illustrating in detail a preferred form of the retaining and detaining means, shortly after the commencement of filling of the apparatus with fluid.

FIG. 5 is a fragmented sectional view illustrating an alternative embodiment in which the piston member is not attached to the bladder.

DETAILED DESCRIPTION OF THE PREFERRED EMBODIMENT

Referring first to FIG. 1, there is shown a typical container 10 for a fluid product. The container 10 may be of any suitable desired material, typically fibrous material, metal, plastic, cellulosic or some combination of these. Also, the container may be of any desired shape, although the container is usually cylindrical.

The container 10 shown in FIG. 1 comprises basically a cylindrical wall or tube 12 closed on one end by a bottom member 14 and a domed top closure member 16 on the other end. Although the bottom member 14 is shown as having a concave shape, it will be appreciated that the bottom could be flat or even convex, if desired. Seated in the top closure member 16 is a mounting cup 18 for holding the valve assembly designated generally as 20. The various peices of the container 10 may be simply mechanically crimped or otherwise fastened together.

Any one of a wide variety of valve assemblies may be used or adapted for use with the apparatus of the present invention. The particular valve assembly used is not critical to the operation of the invention, but instead will depend upon the particular fluid or fluids to be dispensed and the desired spray properties as the fluid is expelled from the container through the valve assembly.

For the purposes of illustration only, there is shown in FIG. 1 an example of one conventional valve assembly 20. It will be evident that many other conventional valves for aerosols or other pressure packaging may be used with the present invention. However, as will become apparent as this description proceeds, it is most advantageous to use a valve assembly in which the container may be charged with fluid through the valve, as well as emptied through the valve.

Briefly describing the particular valve illustrated in FIG. 1, the valve assemly 20 comprises basically a valve body or housing 24, a spring 26, a stem portion 28, a gasket 30 and an actuator-spray tip 32. The parts of the vavle assembly 20 are held together and in place by the crimped inner portions 34 of the mounting cup 18. The actuator-spray tip is provided with an orifice 36 of the appropriate shape and design for the desired spray characteristics of the fluid to be dispensed.

The valve assembly 20 is shown in FIG. 1 in its closed position, with the stem orifice 38 sealed by gasket 30. To operate the valve, the actuator-spray tip 32 is depressed, which causes the stem orifice 38 to be lowered out of sealing engagement with gasket 30. This allows the fluid, which is under pressure, to flow through the tail-piece orifice 40 and the tail-piece 42 of valve body 24, into the valve body per se and around the lower portion 44 of stem 28, into stem orifice 38. The fluid then passes through stem 28 and out spray orifice 36 of the actuator-spray tip 32. Upon removing the finger from the actuator-spray tip 32, the stem 28 is forced upward by spring 26. As a result, stem orifice 38 resumes its sealed position with gasket 30, so that the valve is again closed and the dispensing of fluid is stopped.

Turning now to the essential features and improvements of the present invention, the interior of the container 10 is provided with an expandable resilient bladder 46 and an extensible means indicated generally as 48, for mechanically tensioning the bladder 46. The bladder 46 is shown in FIG. 1 in its full or substantially full, expanded condition, whereby the resilient character of the bladder is serving to exert pressure on the fluid contained therein.

The bladder 46 and extensible means 48 are attached at their upper end to the tail-piece 42 of the valve assembly. Any suitable attachement means which will provide a secure seal may be used. In the embodiment shown, the bladder 46 and extensible means 48 are simply attached by means of a compression ring 50.

If desired, the bladder 46 may be provided with an inner lining 52, which may be attached or unattached to the bladder 46. When used, the liner 52 serves as a barrier layer to prevent contact between the fluid 54 contained within the bladder and the inner surface of the bladder 46. Thus, some fluids which it may be desired to dispense may be incompatible with the elastomeric materials used to form the bladder 46. For example, certain corrosive fluids, or alkaline or acid solutions may tend to attack the elastomeric bladder material and either tend to destroy the integrity and strength of the elastomer or harden the elastomer so that it is no longer resilient. Moreover, a liner 52 is also necessary if it is desired to use a porous material for the bladder 46.

The liner 52 may be made of any suitable material which is compatible with the fluid to be dispensed. The liner material may be either an elastomeric material which expands as the bladder, or a non-elastomeric material, such as polyethylene, polypropylene or other polymers, polymer blends, or laminates. If a non-elastomeric material is used for the liner 52, the liner may either hand loosely inside the bladder in the unfilled position, as shown in FIG. 3, or the liner 52 may be provided with corrugations or accordion-like folds, such as are now commerically available from Continental Can Co. under the trademark "Sepro".

The bladder 46 may be made from any of a wide variety of resilient materials, particularly elastomers, which may include natural gum rubber or synthetic rubbers or elastomers. A wide variety of such elastomeric materials is known in the art, and the particular material chosen will depend on a number of factors of the particular system, including size and volume of the container and the nature of the fluid to be dispensed.

The bladder 46 may be either a continuous membrane or a mesh tube or membrane with elastic properties. If a continuous, non-porous membrane is used, and the fluid to be dispensed is compatible with bladder material, the liner 52 may be omitted.

The particular size and shape of the bladder in its untensioned state may also vary considerably depending upon the particular application and conditions desired. For example, the wall thickness of the untensioned bladder will depend upon the degree of expansion required and the desired pressure to be exerted on the fluid. Untensioned wall thicknesses of up to about ⅛ of an inch will usually be sufficient.

Although elastomeric bladders of the prior art have generally consisted of formed or dipped bags or tubes, the present invention may use either such formed or dipped tubes or extruded tubes. The advantage of being able to use an extruded tube for the bladder is that there is a greater flexibility in manufacturing bladders for a wide variety of sizes, thicknesses, shapes and elastomeric materials. Thus, although the embodiment illustrated in FIG. 1 simply shows a generally cylindrical oblong bladder shape, the bladder 46 may be designed to conform to the interior of virtually any desired container shape. The flexibility of materials allowed by using extruded tubular members for the bladder 46 allows the provision of more uniformity of expansion, greater resistance to permeation, and other advantages.

Turning to the construction of the extensible means 48, the preferred embodiment shown in the accompanying drawings comprises a tubular member 56 and a piston member 58 which slides on or in the tubular member from a non-extended position as shown in FIG. 3 to the extended position shown in FIGS. 1 and 2. Both the tublar member 56 and the piston member 58 should be relatively rigid so that they will not be substantially deformed under the pressure of the tensioned and expanded bladder. Suitable materials for forming the tubular member 56 and the piston member 58 include polyethylene, polypropylene, nylon, and many other materials which will be evident to those of ordinary skill in the art.

Although the embodiment shown in the drawings only includes one tubular member and one piston member, it will be understood that a plurality of relatively rigid telescoping members could be used to form the extensible means.

The tubular member 56 may be fastened to the tailpiece 42 of the valve body in any suitable manner. Alternatively, the tubular member 56 could be formed integrally with the tailpiece 42 of the valve body. The bladder 46, and the liner 52 if used, may then be clamped to the outer perimeter of the tubular member 56, or if desired, the bladder and liner may be attached and clamped between the mounting cup 18 and the top closure member 16 of the container.

At its lower end, the tubular member 56 is provided with detaining means 60 and retaining means 62. In the embodiment shown, both the detaining and the retaining means consist of a small projecting bead from the inner surface of the tubular member 56. However, other devices will be apparent to those of ordinary skill in the art. As will be discussed more fully in connection with FIG. 4, the detaining means 60 prevents the piston member 58 from retracting to its non-extended position, and the retaining means 62 prevents the piston member 58 from being forced out of engagement with the tubular member 56.

Between the detaining means 60 and the tail-piece orifice 40, the wall of the tubular member 56 is provided with aperture means 64 through which fluid 54 may pass into and out of the bladder. Thus, the tubular member 56 and aperture means 64 provide a fluid outlet means by which the valve assembly communicates with the interior of the bladder. Although the aperture means 64 shown in the drawings comprises two holes, theoretically only a single hole would be needed, and alternatively a plurality of holes along the length of the tubular member 56 may be used. Also, if desired, apertures 64 may be located near the top end of tubular member 56 to allow fluid to enter the bladder substantially simultaneously with the initiation of downward movement of piston member 58, but it is preferred that apertures 64 not be uncovered until piston 58 is almost fully extended.

The piston member 58 may consist of a solid rod-like structure having a peripheral flange 66 and a centering pin 67 at its upper or inner end. The piston member 58 should be of such a length as to extend substantially past the lower end of tubular member 56 when the extensible means 48 is in its extended position. As shown in FIG. 1, the piston member 58 may extend short of the bottom 14 of the container 10. However, if desired, the piston member 58 may extend all of the way to the bottom 14 in the extended position.

The flange 66 on the upper or inner end of piston member 58 is shown in more detail in FIG. 4 in connection with the detaining means 60 and the retaining means 62. The detaining bead 60 should be small enough to allow the flange 66 to pass as the piston member 58 is forced downward to its extended position. On the other hand, the retaining bead 62 should be large enough to prevent the flange 66 from slipping past the retaining bead 62 and consequently out of engagement with the tubular member 56. However, as the tension of the bladder tends to urge piston member 58 back upward toward its non-extended position, flange 66 should catch on detaining bead 60, and the flange 66 will reverse to the position shown in FIGS. 1 and 2.

The lower end of the piston member 58 may be attached or unattached to the bladder 46. In the embodiment shown in FIGS. 1, 2 and 3, the bladder is a tubular member having an opening 68 at its lower end. As shown in FIGS. 1, 2 and 3, the lower bladder opening is sealed around the lower or outer end of the piston member 58 by means of a compression ring 70 and compression ring groove 72 in the end of the piston member 58. Alternatively, as shown in FIG. 5, the bladder 46 may be continuous at its lower end 74, so that the piston member 58 need not be attached to the bladder but is rounded to prevent rupture of the bladder.

However, it is believed most advantageous to have the piston member 58 attached to the bladder 46, such as is shown in FIGS. 1, 2 and 3 for several reasons. First of all, the attached embodiment allows for the use of an extruded tubular member for the bladder 46, rather than a formed or molded bladder such as shown in FIG. 5. Secondly, by having the bladder 46 attached to the piston member 58, the tensioning action on the bladder 46 is more of a pulling motion, rather than a pushing, or poking motion which could tend to tear the bladder. Thirdly, where the piston member and bladder are unattached, the lower end of the piston member 58 may contact the bladder 46 off-center, so that the tensioning of the bladder may be uneven on the various sides.

The method of the present invention and the operation of the apparatus of the present invention will now be described with particular reference to FIGS. 1, 2 and 3. Prior to commencement of the filling of the dispensing apparatus with fluid, the bladder 46, liner 52 and extensible means 48 (including tubular member 56 and piston member 58) will appear as in FIG. 3. Thus, the extensible means 48 will be in its non-extended position, so that the bladder will be substantially untensioned. If the liner 52 is a non-elastomeric material (as shown), it will hang in a wrinkled or folded condition between the bladder 46 and the extensible means 48. As shown, the bladder 46 and liner 52 should conform fairly closely to the outer surface of the extensible means 48, although sufficient clearance is desirable to allow ease of insertion of the extensible means 48 into the bladder 46 during assembly of the apparatus.

In order to commence filling the dispensing apparatus, the actuator-spray tip 32 is removed from the top of the stem 28 of the valve assembly. Preferably, the valve assembly, such as the one shown in FIG. 1, is of the type which allows filling of the apparatus through the same valve as the fluid is dispensed. In this manner, conventional filling apparatus may be used, in which the filling apparatus connects to the stem 28 and depresses the stem to open the valve for filling. The filling apparatus will not be described since such are well known in the art for filling pressurized dispensers.

As the filling of the dispenser apparatus commences, the fluid being forced through the valve assembly pushes against the flange 66 and the top of piston member 58 so that the piston member is forced downwardly to actuate the mechanical tensioning of the bladder 46. As the flange 66 passes the aperture means 64, fluid will then be admitted to the bladder, and the bladder will begin to expand. For this reason, it is preferable that the aperture means be located only slightly above the detaining means 60 so that the piston member 58 will be almost in its extended position by the time filling of the bladder actually commences.

Even with the introduction of fluid into the bladder, piston member 58 will enventually continue to be forced downwardly past detaining means 60. With conventional filling apparatus, the filling of the dispenser may be completed in a matter of a second or two or less. As a result, piston member 58 is forced downwardly with great force. Therefore, it is preferred that piston member 58 be of such a length that it will touch the bottom 14 of container 10 just before or about the time flange 66 reaches retaining means 62 so that flange 66 cannot be forced past retaining means 62. Centering pin 67 provides additional stability to piston member 58 at or near its extended position, thereby resisting lateral movement of the bottom end of piston member 58 which might pull piston 58 out of tubular member 56.

As the bladder continues to be filled, and the filling nears completion, the downward pressure of the fluid on piston member 58 will diminish, and the tension of the bladder 46 will tend to urge piston member 58 back upwardly unit it contacts detaining means 60 and the flange 66 reverses to lock the piston member 58. In this manner, piston member 58 is prevented from returning to its non-extended postion, and the mechanical tensioning of bladder 46 is maintained at least until substantially all of the fluid is dispensed from the apparatus.

As the fluid is dispensed from the apparatus, the bladder exerts pressure on the fluid, which pressure is caused both by the expanded state of the bladder filled with fluid and by the mechanical tensioning of the bladder by extensible means 48. Throughout the evacuation of the bladder, the mechanical tensioning provided by extensible means 48 in its extended position maintains a high level of pressure on the fluid being dispensed. That is, this mechanical tensioning, or post-tensioning as it may be called, insures the maintenance of a pressure level required to expel substantially all of the fluid from the apparatus at an even pressure.

The substantially empty state of the bladder is illustrated in FIG. 2 of the drawings. As can be seen, the bladder is still tensioned along its longitudinal axis by the extensible means 48, so that the walls of the bladder 46 are caused to hug the extensible means 48 very closely and therefore expel as much of the fluid product as possible. This post-tensioning of the bladder insures that there will be a substantially uniform pressure throughout the dispensing of the fluid, without significant diminishing of the pressure as the apparatus is emptied.

Although applicant does not wish to be bound by any particular theory, it is believed that there is a significantly different effect on the elastomeric properties of the bladder with the post-tensioning of the present invention than with the prestressing or tensioning of the prior art. Thus, in the prior art, where the bladder is pre-stressed prior to introduction of fluid into the dispenser, it is believed that there is a partial setting of the elastomeric material which setting is increased as the dispenser sits in storage prior to filling. As a result of this partial set, it is believed that upon dispensing of the fluid, the pres-stressed bladder will only tend to return to a position somewhat short of the partial set position, instead of to somewhat short of the original non-prestressed conditioned of the elastomer. As a result, all of the fluid may not be dispensed from the apparatus, and the pressure will diminish as the dispenser nears its empty point.

On the other hand, with the post-tensioning of the present invention, there is believed to be little or no partial setting of the elastomer, since the mechanical tensioning is not carried out until the dispenser is actually being filled. As a result, the bladder of the present invention will still tend to return to close to its original non-tensioned condition rather than some intermediate partial set condition. Consequently, there will be a greater possibility of discharging substantially all of the fluid, and the pressure will remain substantially undiminished throughout the dispensing.

Confirmation of the above concept is provided by the fact that with pre-stressing of the bladder, the maximum pressure is not reached during filling until perhaps 40 or 50 percent of the filling has been completed. In contrast, with the post-tensioning of the present invention, the maximum pressure exerted by the bladder on the fluid is reached after only about 10 percent of the filling has been completed.

Additionally, pressures well over 20 psig have been developed with the post-tensioning of the present invention, and minimum pressures of from 10 to 20 psig can easily be maintained throughout the dispensing of the fluid. Such pressures are necessary for the finer degrees of atomization required, for example, for hair care products and other sprays.

Although the present invention is particularly suited to the dispensing of various liquids, the method and apparatus may be used to dispense a wide variety of fluids, including high viscosity pastes, liquids and semi-solids, and vapor-liquid mixtures.

An example of a typical eight fluid ounce liquid dispenser according to the present invention includes the following: The container 10 consists of a six inch tall fiber (e.g. cardboard) cylinder having aluminum or tin plated steel ends. The bottom end is flat and the top end is domed and pierced to accept a one inch diameter valve mounting cup. A valve assembly available from the Newman-Green Company is used, in which the stem 28 is integral with the actuator 32, and filling is accomplished through a tube inserted through gasket 30.

Tubular member 56 is made of a three inch long nylon tube having a ¼ inch O.D., a 3/32 inch I.D., and having two 1/10 inch diameter apertures located about ¼ inch above the detaining means 60. Piston member 58 is a three inch long solid nylon rod having an O.D. of slightly less than 3/32 inch. The integral flange 66 is about ¼ inch in length, and centering pin 67 is about ½ inch in length.

Liner 52 consists of a cylindrical bag of 4 mil thick high density polyethylene having a diameter of 2¼ inches and a length of 6 inches. The bladder 46 is an extruded tube of silicone rubber from the General Electric Company, having a length of 4 inches, a ½ inch O.D., 5/16 inch I.D., and 3/32 inch wall thickness. Hence, the bladder will have a longitudinal extension of about 50 percent when mechanically tensioned. The bladder is fastened to the valve assembly at one end and the piston member 58 at the other end by aluminum blend compression rings, such as available from the Tipper-Tie Company, a division of Rheem Manufacturing Co. of Union, New Jersey.

The present invention may be embodied in other specific forms without departing from the spirit or essential attributes thereof and, accordingly, reference should be made to the appended claims, rather than to the foregoing specification as indicating the scope of the invention.

I claim:

1. A method for dispensing a fluid under pressure from a container for the fluid by means of an expanded resilient bladder which contains the fluid, and wherein the resilient character of said expanded bladder provides the pressure for expelling the fluid from said bladder, the improvement comprising tensioning said bladder by the introduction of fluid into the bladder, mechanically tensioning said bladder, said mechanical tensioning being applied internally of said bladder, said mechanical tensioning being substantially fully applied by fluid entering said container but prior to fluid entering said bladder, and dispensing the fluid while releasing the fluid tensioning of said bladder, but while maintaining said mechanical tensioning of said bladder at least until substantially all of the fluid is expelled therefrom.

2. A method according to claim 1 wherein said bladder is elongated and said mechanical tensioning is applied by extending said bladder along the longitudinal axis of said bladder.

3. A method according to claim 1 wherein said bladder is in a substantially untensioned state prior to commencement of the filling of said container with fluid.

4. A method according to claim 3 wherein said mechanical tensioning is actuated by the commencement of the filling of said container with fluid.

5. A method according to claim 1 wherein said mechanical tensioning causes said bladder to provide a pressure on said fluid of at least about 10 to 20 psig which pressure is substantially undiminished throughout the dispensing of fluid from said container.

6. In an apparatus for dispensing fluid under pressure including a resilient bladder defining a chamber for containing the fluid and fluid outlet means communicating with the interior of said bladder, the improvement comprising extensible means for tensioning said bladder, said extensible means being located interior of said bladder and being operable between a first non-extended position wherein said bladder is substantially untensioned and a second extended position wherein said bladder is tensioned, said extensible means comprising at least two relatively rigid telescoping members, said members being slidable with respect to each other from said first non-extended position to said second extended position, a first telescoping member comprising a tubular member leading from said fluid outlet means, whereby said apparatus is filled and emptied through said tubular member, a second telescoping member comprising an elongated piston member, said piston member being slidable on said tubular member such that when fluid is forced into said tubular member, said piston member is caused to move to its extended position whereby said bladder is longitudinally tensioned, means for preventing fluid from entering said bladder until said extensible means has become substantially fully extended and means for detaining said extensible means in said extended position at least until substantially all of the fluid is dispensed from said apparatus.

7. An apparatus according to claim 6 wherein said tubular member has aperture means in the side wall thereof through which fluid may pass into and out of said bladder.

8. An apparatus according to claim 6 wherein said tubular member and said piston member have retaining means thereon to prevent said piston member from sliding off said tubular member.

9. An apparatus according to claim 6 wherein one end of said piston member is attached to said bladder.

10. An apparatus according to claim 6 wherein said bladder is provided with an inner lining to prevent contact between said fluid and said bladder.

11. An apparatus according to claim 10 wherein said bladder comprises an elastomeric material and said lining comprises a non-elastomeric material.

12. An apparatus according to claim 6 wherein said bladder comprises an extruded tube of elastomeric material.

13. An apparatus according to claim 6 wherein said piston member is slidable within said tubular member and said detaining means comprises bead means projecting from the inner surface of said tubular member and reversible flange means projecting from the inner end of said piston member.

14. An apparatus according to claim 6 wherein said piston member is not attached to said bladder.

15. An apparatus according to claim 10 wherein both said bladder and said lining comprise elastomeric materials.

* * * * *